United States Patent [19]

Faulkner et al.

[11] 4,079,282

[45] Mar. 14, 1978

[54] PHOTOTUBE HAVING APERTURED ELECTRODE RECESSED IN CUP-SHAPED ELECTRODE

[75] Inventors: Richard Dale Faulkner; Robert Edwin McHose, both of Lancaster, Pa.

[73] Assignee: RCA Corporation, New York, N.Y.

[21] Appl. No.: 652,161

[22] Filed: Jan. 26, 1976

[51] Int. Cl.[2] ..... H01J 39/00; H01J 39/04

[52] U.S. Cl. ..... 313/95; 313/99

[58] Field of Search ..... 313/95, 102, 94, 99, 313/101

[56] References Cited

U.S. PATENT DOCUMENTS

| | | | |
|---|---|---|---|
| 2,121,636 | 6/1938 | Koller | 313/101 |
| 2,908,840 | 10/1959 | Anderson | 313/94 |
| 3,753,023 | 8/1973 | Sommer | 313/94 |
| 3,875,441 | 4/1975 | Faulkner | 313/95 |

FOREIGN PATENT DOCUMENTS

| | | | |
|---|---|---|---|
| 250,125 | 3/1964 | Australia | 313/95 |
| 1,098,631 | 2/1961 | Germany | 313/95 |

*Primary Examiner*—Robert Segal

*Attorney, Agent, or Firm*—E. M. Whitacre; G. H. Bruestle; R. M. Rodrick

[57] ABSTRACT

A phototube includes a cup-shaped apertured electrode interposed between a substantially flat cathode and an electron collection electrode. Anapertured electrode is coaxially secured within the recess of the cup-shaped electrode in parallel spaced-apart facing relation to the cathode.

17 Claims, 1 Drawing Figure

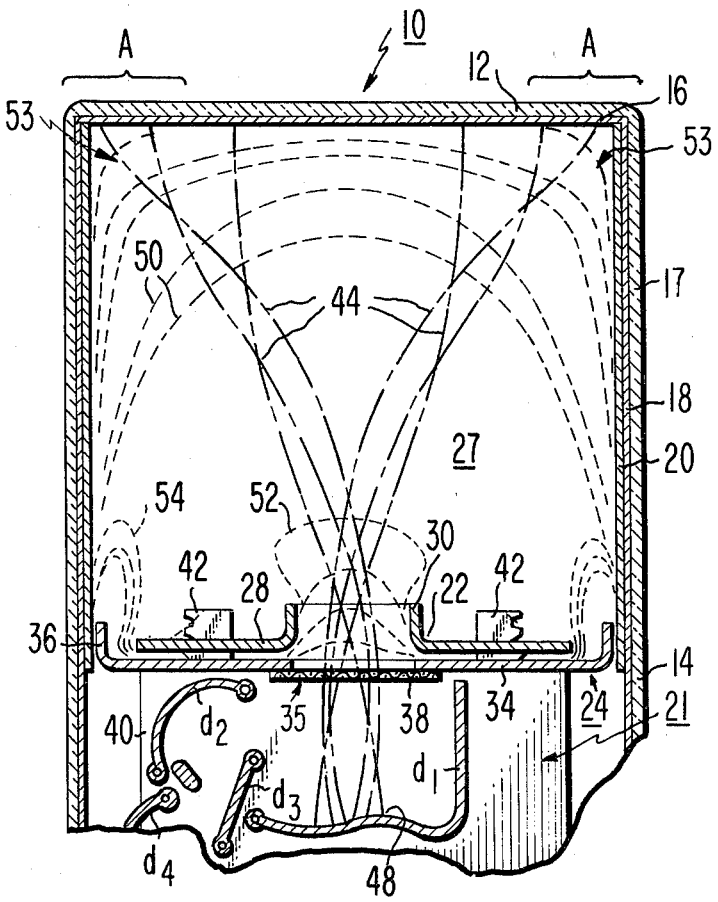
10
A
A
12
16
53
53
50
44
17
18
27
20
54
52
30
42
28
22
42
36
14
35
38
34
24
21
40
d2
d1
d3
d4
48

PHOTOTUBE HAVING APERTURED ELECTRODE RECESSED IN CUP-SHAPED ELECTRODE

BACKGROUND OF THE INVENTION

The present invention relates to electron discharge devices and more particularly to phototubes such as photomultiplier tubes.

A phototube is an electron discharge device which is particularly useful for detecting an input signal in the form of radiation which impinges on an input surface of the device. A photocathode converts the impinging radiation into a stream of electrons which is ultimately collected by an anode to produce an electrical output signal related to the real time magnitude of the collected electron stream.

In photomultipliers, an electron multiplier is interposed between the photocathode and anode to provide, in ordered sequence, one or more electrode stages of electron multiplication. An electric field between the photocathode and the succeeding electrodes acts as an electron lens whereby the various electrons of the electron stream are accelerated within an evacuated cavity to impinge upon each of the succeeding electrodes in ordered sequence.

Phototubes have generally been limited to their ability to uniformly convert and amplify information in the form of an incident radiation signal event into a useful signal output independent of its point of incidence along the input surface. For example, undesirable variations in signal output level and pulse height resolution are known to occur depending upon the point of incidence of the signal event along the input surface and the photocathode associated therewith. One reason for this deficiency has been an inability of one or more electrodes to completely and uniformly collect all the electrons emitted from the entire effective photocathode surface. Prior art electron lens systems are generally unable to provide the desired optimum focussing of the entire electron stream. As a consequence, a significant percentage of the electrons which are emitted from the peripheral portions of the cathode do not result in a useful anode signal output.

BRIEF DESCRIPTION OF THE DRAWING

The FIGURE of the drawing is a partial cross-sectional view of a photomultiplier tube made in accordance with the invention.

SUMMARY OF THE INVENTION

In an electron discharge device, an electrostatic means is provided for modifying the electron accelerating and focussing field to be substantially in conformity with the contour of an electron emissive surface of a cathode of the device, in the region of an electron accelerating cavity proximate to that cathode surface, whereby improved uniformity of output signal characteristics may be achieved.

DESCRIPTION OF THE PREFERRED EMBODIMENTS

Referring now to the drawing, there is shown an input portion of a "head on" type photomultiplier tube 10. The input surface of the tube 10 comprises a substantially flat surface of a transparent glass faceplate 12 at one end of an evacuated envelope 14. A transmissive type semitransparent photocathode 16 is provided on a surface of the faceplate 12 within an evacuated interior of envelope 14. Such photocathodes are well known in the art and may comprise photoemissive material compositions such as, for example, disclosed in U.S. Pat. No. 2,914,690, issued to A. H. Sommer on Nov. 24, 1959. The envelope 14 also includes a tubular central portion 17 having an interior elongated side wall surface portion with an aluminized coating 18. The interior surface of coating 18 is preferably cylindrical and may also include a photocathode 20 of a reflective type, comprising a photoemissive material composition similar to that of photocathode 16.

An electron multiplier 21 is coaxially secured within the evacuated interior of envelope 14 in spaced-apart relation to the photocathode 16 by means of lead wires (not shown) secured to a plurality of lead-in pins protruding through a stem region of the tube 10 (not shown) in a manner well known in the art. An annular electron focussing electrode 22 and a field forming electrode 24 are secured to an end of electron multiplier 21 which faces photocathode 16, coaxially within the evacuated interior of the tubular portion 17. The interior surfaces of photocathodes 16,20 and the surfaces of electrodes 22 and 24 facing the faceplate 12 together substantially enclose a portion of an evacuated electron acceleration cavity 27.

Focussing electrode 22 includes a substantially flat disc-shaped portion 28, and a centrally located inner cylindrical tubular portion 30 which extends substantially perpendicular from the flat portion 28 toward the faceplate 12. Field forming electrode 24 is cup-shaped and includes an apertured substantially flat disc-shaped mounting portion 34, and an outer cylindrical flange portion 36 extending substantially perpendicular from the flat portion 34 toward the faceplate 12 into the electron acceleration cavity 27 about the peripheral edges of disc-shaped portion 28 of the focussing electrode 22. Disc-shaped portion 34 includes a central aperture 35 across which an electron permeable wire mesh 38 is secured.

The focussing electrode 22 is coaxially positioned within the cup-like cavity or recess of the field forming electrode 24 so that a through opening in tubular portion 30 is aligned with the electron permeable mesh 38. Disc-shaped portions 28 and 34 are closely positioned in facing electrically isolated spaced-apart relation to each other. The facing surfaces of the disc-shaped portions 28 and 34 are preferably secured in spaced-apart aligned substantially parallel relation to each other by mechanical means such as, for example, an electrode support structure of the multiplier 21.

The support structure of the tube 10 includes a pair of substantially parallel spaced-apart ceramic electrode mounting spacers 40 (one of which is depicted in the drawing) for mounting the electrodes of the multiplier 21 in a manner well known in the art. A plurality of mounting tabs 42, extending from each of the spacers 40, protrude through, and are secured within, slotted regions in each of the electrodes 22 and 24.

Electron multiplier 21 includes, for example, a series of dynode electrodes $d_1$–$d_n$ ($d_5$–$d_n$ not shown) and an anode (not shown) wherein "$n$" symbolizes the number of dynode electron multiplication stages desired.

Various types of electron multiplier constructions may be employed in tube 10 to advantage, and their construction and operation is well known to persons skilled in the art of electron discharge devices. For example, such devices may be constructed with their dynodes arranged in a circular cage fashion, as partially depicted in FIG. 1, or as an elongated staggered series of dynodes, as for example, shown in U.S. Pat. No. 2,908,840 issued to R. H. Anderson on Oct. 13, 1959.

During operation of tube 10, appropriate electric potentials must be applied to each of the respective electrodes of tube 10, and photocathodes 16 and 20. Such potentials may, for example, be applied by means of the aforementioned lead wires connected to lead in pins which protrude from a stem portion of the tube 10 (not shown) in a manner well known in the art.

In the operation of the tube 10, the photoemissive material of photocathodes 16 and 20 act as sources of photoelectrons. Photoelectrons are emitted as a stream of electrons from the photoemissive material of each of the photocathodes 16 and 20 in response to the light in the form of an input signal event which impinges thereon. These photoelectrons are merged or concentrated by an electric field within cavity 27 and are substantially accelerated thereby as a single electron bundle through the through opening in the tubular portion 30 of electrode 22 and the mesh 38 of electrode 24 to ultimately impinge upon the dynode $d_1$. The electric field is electrostatically generated within cavity 27 by an electron lens system primarily comprising: photocathode 16; aluminized coating 18 and photocathode 20 thereon; electrodes 22, 24; and dynode $d_1$. In general, the electric field may be generated by magnetic and/or electrostatic means, as is well known in the art of electron discharge devices.

Referring to the drawing, several typical electron trajectories 44 are depicted for photoelectrons which are emitted from the photocathode 16, respectively, as a stream of electrons onto cavity 27 whenever a uniform input light signal event is scanned across, of focussed over, the entire input surface of the faceplate 12 of an operative tube 10.

In order to generate a useful anode output signal current from the operative tube, the emitted photoelectrons must impinge upon the "active" input surface of (i.e. be collected by) the dynode $d_1$. The "active" surface comprises a surface region of dynode $d_1$ from which secondary electrons may be generated, and from which the secondary electrons may then be properly accelerated as an electron stream to other ones of the electrodes (dynodes $d_2$-$d_n$), in ordered sequence, for ultimate collection by the anode. Ideally, all emitted photoelectrons are electrostatically accelerated to impinge upon acitve region 48. In practical devices, however, the physical area of the active input surface 48 upon which electrons must impinge, is considerably less than that necessary to properly collect all the emitted photoelectrons. As a consequence of this deficiency, undesirable variations in the anode output signal current occur for a given input signal event depending upon the point, or region, of the photocathode upon which it impinges. Such variations in the signal response characteristics of prior art tubes are particularly pronounced for input signal events which are incident along the peripheral regions of the input surface generally designated "A" in the drawing. Referring to the drawing, the electron lens system of tube 10 is designated to minimize such variations by improving the uniformity of the collection of photoelectrons by dynode $d_1$.

In tube 10, the field forming electrode 24 may be connected to a suitable source of electric potential (e.g. the same potential as applied to dynode $d_1$) independent of that applied to the electrode 22. As a consequence of such operation of the tube 10, aspherically-shaped electric fields, which may be generated within cavity 27 by the electrostatic focussing electrode 22 alone, may be modified to include field lines of equipotential 50 which are substantially expanded within the peripheral regions 53 of the cavity 27. The field lines of equipotential so defined are thereby extended substantially parallel to the entire electron emissive surface of the cathode 16 as depicted in the drawing, thereby resulting in an improved uniformity of output signal characteristics. Tubes operated in this fashion have signal output levels and pulse height resolution abiltity for a given input signal event which are substantially independent of the input surface region of the photocathode upon which it impinges.

The expansion of the electric field within the peripheral extremities or regions 53 of the cavity 27 is provided by means of the flange portion 36 of electrode 24 which protrudes within the cavity 27 about the peripheral edges of the focussing electrode 22. During operation of tube 10, flange portion 36 serves as an electrostatic field assist or forming means whereby an electric field (represented by field lines of equipotential 54) is generated about the peripheral regions of electrode 22 which combines and modifies the primary aspherically-shaped field lines of equipotential protruding through the central opening of tubular portion 30 of electrode 22 into cavity 27, to improve the acceleration and collection of electrons emitted from the peripheral region of photocathode 16.

The invention broadly comprises the inclusion of electrostatic means for modifying the electron accelerating and focussing field within an electron acceleration cavity of an electron discharge device to be substantially in conformity with the contour of an electron emissive cathode surface in a region of the cavity proximate thereto whereby output signal response characteristics may be achieved, for a given input signal event, substantially independent of the point of incidence of that event along the cathode of the device.

What is claimed is:

1. An electron discharge device comprising:

(a) an evacuated envelope having a transparent portion and a tubular body, with a portion of the body having a circular cross-section;

(b) a cathode within an internal cavity of said envelope capable of receiving input radiation signals through said transparent portion and of emitting electrons from an electron-emissive surface thereof facing the cavity;

(c) an electrode lens system including:

(i) a cup-shaped field-forming electrode having a flattened base with an electron permeable opening therein, a sidewall, and a substantially circular top opening facing said cathode, the diameter of said top opening being substantially equal to the diameter of the circular cross-section; and (ii) a disc-shaped focusing electrode coaxially secured within said cup-shaped electrode, said focusing electrode being mounted substantially parallel to and insulatingly spaced from the base of said field-forming electrode, said focusing electrode having a central tubular portion with an aperture therein facing said cathode which aperture is also substantially aligned with the electron permeable opening in said base permitting said electrons to be accelerated therethrough; and (d) output means capable of collecting, upon an active surface of an electrode, said accelerated electrons and of generating an electron output signal related to the signal characteristics of said input radiation signal.

2. A device of claim 1 wherein said cathode comprises a photocathode along the inner surface of said transparent portion.

3. The device of claim 2 wherein said photocathode is substantially flat.

4. The device of claim 3, wherein said output means comprises an electron multiplier secured within said tubular body in coaxial relation with said field-forming and focusing electrodes and wherein said active electrode surface comprises an electron emissive surface portion of a first dynode of said multiplier.

5. The device of claim 4 wherein said focusing electrode is secured in substantially parallel spaced-apart facing relation to said electron emissive surface of said photocathode.

6. The device of claim 5 wherein said cavity is partially enclosed by sidewall portions of said tubular body having an interior surface with an electrically conductive coating.

7. The device of claim 6 wherein a photoemissive material extends along a portion of said coating which faces said cavity.

8. The device of claim 7 wherein said cavity is cylindrically shaped.

9. The device of claim 8 wherein said electron permeable opening of said cup-like member comprises an aperture across which an electrically conductive mesh is mechanically secured about its periphery to said member.

10. The device of claim 9, wherein said tubular portion is disposed around the periphery of said aperture and extends towards said cathode.

11. A phototube comprising:

(a) an evacuated envelope including a bulb having a transparent faceplate portion and an elongated sidewall portion extending from said faceplate portion;

(b) a transmissive-type photocathode on a major surface of said faceplate within the interior of said evacuated envelope for emitting photoelectrons from an electron emissive surface in response to light focused to impinge thereon;

(c) an electrode surface within the interior of said evacuated envelope for collecting said photoelectrons, said electrode surface being of smaller area than the surface area from which said photoelectrons may be emitted;

(d) an evacuated electron acceleration cavity within said envelope between said emissive surface and said electrode surface, said cavity being partially enclosed by said elongated sidewall portion of said envelope and at least a portion of said cavity having a circular cross-section;

(e) an electron lens system disposed within said cavity, said electron lens system including (i) a cup-shaped field forming electrode having a flattened base with an electron permeable opening therein, a sidewall, and a substantially circular top opening facing said photocathode, the diameter of said top opening being substantially equal to the diameter of the circular cross section; and (ii) a disc-shaped focusing electrode coaxially secured within said cup-shaped electrode, said focusing electrode being mounted substantially parallel to and insulatingly spaced from the base of said field forming electrode, said focusing electrode having a tubular portion with an aperture therein which is substantially aligned with the electron permeable opening in said base, permitting said photoelectrons to be accelerated therethrough and focused on said electrode surface.

12. The phototube of claim 11, wherein the elongated sidewall portion of said envelope includes a reflective-type photocathode on an inner major surface portion facing said cavity for emitting photoelectrons in response to light impinging upon that photocathode.

13. The phototube of claim 12 wherein said transmissive-type photocathode is substantially flat.

14. The phototube of claim 13 wherein said electrode surface comprises an active electron emissive surface portion of an electron multiplier secured within said bulb in coaxial relation with said field forming and focusing electrodes.

15. The phototube of claim 14, wherein said elongated sidewall portion of said envelope has a cylindrically-shaped interior cavity.

16. The phototube of claim 15 wherein said electron permeable opening of said cup-like member comprises an aperture across which an electrically conductive mesh is mechanically secured about its periphery to said member.

17. The phototube of claim 16, wherein said tubular portion is disposed around the periphery of said aperture and extends toward said photocathode.

* * * * *